US005189590A

United States Patent [19]

Schneider

[11] Patent Number: 5,189,590

[45] Date of Patent: Feb. 23, 1993

[54] CLOSED-LOOP MULTI-SENSOR CONTROL SYSTEM AND METHOD

[75] Inventor: Carl S. Schneider, Annapolis, Md.

[73] Assignee: The United States of America as represented by the Secretary of the Navy, Washington, D.C.

[21] Appl. No.: 823,031

[22] Filed: Nov. 14, 1991

Related U.S. Application Data

[63] Continuation of Ser. No. 558,111, Jul. 25, 1990, abandoned.

[51] Int. Cl.[5] ..... B63G 9/06; H01F 13/00

[52] U.S. Cl. ..... 361/149; 307/101; 361/267

[58] Field of Search ..... 361/143, 146, 147, 149, 361/267; 307/101; 335/23; 114/270

[56] References Cited

U.S. PATENT DOCUMENTS

| | | | |
|---|---|---|---|
| 2,832,041 | 4/1958 | Trachtenberg | 361/149 |
| 3,110,282 | 11/1963 | Foerster | 361/149 |
| 3,215,904 | 11/1965 | Burt | 317/157.5 |
| 3,549,987 | 12/1970 | Hall et al. | 324/5 |
| 4,373,174 | 2/1983 | Akesson | 361/143 |
| 4,734,816 | 3/1988 | Guillemin et al. | 361/149 |
| 4,812,759 | 3/1989 | Duthoit | 361/149 |
| 4,823,081 | 4/1989 | Geisler | 361/146 |
| 4,945,446 | 7/1990 | Kuroda et al. | 361/146 |

*Primary Examiner*—A. D. Pellinen
*Assistant Examiner*—Richard Elms
*Attorney, Agent, or Firm*—Charles D. Miller; Luther Marsh

[57] ABSTRACT

A closed-loop multi-sensor control system for controlling ship signatures at positions away from local sensors used to direct local signatures controllers by controlling a field variable signature through local onboard sensors and active coil elements by determining a transfer matrix between discrete local and midrange field values, said determination being based upon virtual sources, M, and control parameters (coil currents) I wherein:

$$M=(M_{X1},M_{Y1},M_{Z1},M_{Z2}\ldots M_{ZX}) \text{ and } I=(I_1,I_2,\ldots I_M),$$

wherein local signatures $H=A_H I_O+B_H M$ and wherein midrange signatures $K=A_K I+B_H M$ and wherein the ultimate solution for the coil currents for optimum degaussing is:

$$I=-(A_K{}^T A_K)^{-1} A_K{}^T B_K (B_H{}^T B_H)^{-1} B_H{}^T (H-A_H I_O)=G\,H_{eff}$$

3 Claims, 1 Drawing Sheet

CLOSED-LOOP MULTI-SENSOR CONTROL SYSTEM AND METHOD

This application is a continuation of application Ser. No. 07/558,111, filed Jul. 25, 1990, now abandoned.

The invention described herein may be manufactured and used by or for the Government of the United States of America for governmental purposes without the payment of any royalties thereon or therefor.

BACKGROUND OF THE INVENTION

This invention is directed to the control of a field variable signature through local sensors and active elements by determining a transfer matrix between discrete local and midrange field values. Data bases are accumulated on any platform for a magnetic field due to degaussing coil activation and to various magnetic states at local and midrange sensor sites.

The hulls of seagoing vessels constructed of ferromagnetic materials exhibit both permanent and induced magnetic properties. The magnetic field, or signature, of these material sources is a significant fraction of the Earth's field and is not linearly proportional nor parallel to the Earth's field. Nor is the distribution of magnetized materials homogeneous throughout the vessel. Other factors such as hydrostatic pressures acting on the hull, vibrations imparted to the hull by various machinery, as well as the particular orientation of the vessel with respect to the Earth's magnetic field all contribute to the variability of the magnetic state (the equivalent distributed dipole source strength) of the vessel. Since the presence of a magnetic field around the vessel which is dissimilar to its magnetic environment permits detection of the vessel by, for example, magnetic anomoly detection sensors carried aboard aircraft, a means of nullifying the net magnetization of the vessel, and thus the magnetic signature of the vessel, is especially desirable.

Current methods of determining a vessel's magnetic state and its signature, involve the measurement of the vessel's external magnetic field using a degaussing range each time such knowledge is desired. This costly and time consuming effort is often not a reliable indicator of the vessel's magnetization at a later time because of variations of the magnetic state with time. Further, magnetization of vessel materials is known to vary widely under the influence of pressure, temperature, and external magnetic fields so that onboard measurements and self-monitoring of the vessel's magnetic state is needed to determine the vessel's magnetic state to provide input to a degaussing coil current controller.

SUMMARY OF THE INVENTION

To control signatures at positions away from local sensors which are used to direct local controllers is one general purpose of this invention and a true improvement to this art.

The present invention illustrates a closed-loop multi-sensor system and method for controlling a ship platform magnetic state by placing and spacing degaussing coils strategically on said platform for degaussing, placing and spacing sensors on said ship platform hull for measuring near field signatures, placing and spacing midrange sensors without said ship platform for initially measuring midrange signatures measuring simultaneously hull signatures and keel signatures using said hull sensors and range sensors (Keel sensors) for preparing said coil and magnetic state signature matrices, determining the control matrix of the hull signatures, and controlling said coil and magnetic states signatures by cyclically determining the coil currents from the hull signatures using said control matrix for control purposes.

More specifically the present invention illustrates a closed-loop multi-sensor control system for controlling platform magnetic signatures at positions away from local sensors used to direct local magnetic signature controllers comprising a plurality of degaussing coils within said platform for degaussing, a plurality of platform sensors on said platform hull for measuring near field magnetic state signatures, a plurality of range sensors without said platform for initially measuring midrange magnetic field signatures, means for measuring simultaneously said hull sensors and range sensors for preparing said coil and magnetic state signature matrices, means for determining the control matrix of the coil currents and hull magnetic signatures, and means for controlling said coil and magnetic state signatures by cyclically determining said coil currents and magnetic state signatures using said control matrix for control purposes.

OBJECT OF THE INVENTION

Figure 1:
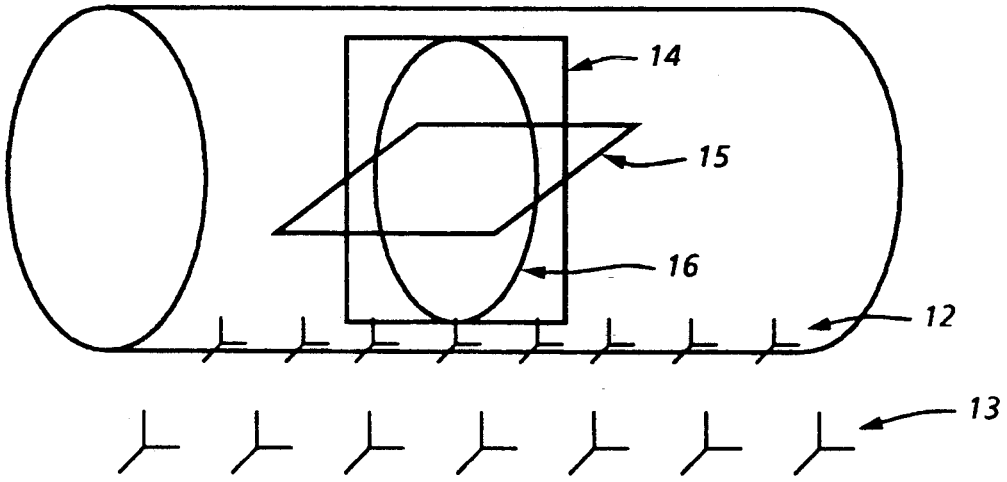
FIG. 1 illustrates a system for controlling the magnetic field around a three dimensional space.

It is accordingly an object of the present invention to provide a system and method using closed loop degaussing having multiple sensors and multiple coils for ship platforms.

Another object of the present invention is to provide a system and method using closed loop degaussing utilizing multiple sensors and magnetoelastic theory for minimizing ship platform signatures both in diving and voyages.

A further object of the invention is to provide the control of a field variable through local sensors and active elements by determining a transfer matrix between discrete local and midrange values. "Midrange" means sufficiently removed from the vessel that the coil system is adequate to zero the signature.

A still further object of the invention is to provide data bases for any ship platform on a magnetic field due to degaussing coil activation and to various magnetic states at local and distant sensor sites.

Another object of the invention is to provide capability for controlling signatures at positions away from local sensors which are used to direct local signature controllers.

With these and other objects in view, as will hereinafter more fully appear, and which will be more particularly pointed out in the appended claims, reference is now made to the following description taken in connection with the accompanying drawing in which FIG. 1 shows a closed-loop multi-sensor control system for controlling ship platform signatures in accordance with this invention.

DETAILED DESCRIPTION OF THE INVENTION

The control of a field variable signature through local on board sensors 12 and active elements, namely coils, 14, 15, and 16 is accomplished by determining a transfer matrix between discrete local (12) and midrange (13)

field values. The closed-loop multi-sensor controller of this invention is based upon virtual sources, M, and control parameters coil currents I. Generalized vectors are applicable in this invention as:

$$M=(M_{X1},M_{Y1},M_{Z1},M_{X2},\ldots M_{Zn}) \text{ and } I=(I_1,I_2,\ldots I_m)$$

where the total number of elements, or degrees of freedom of the system is m which approximates 3n.

The local fields (H: hull signatures) are initially:

$$H=A_H I_O+B_H M \quad (1)$$

while the midrange field (K: keel signatures) are removed or zeroed:

$$K=A_K I+B_K M=0 \quad (2)$$

The A matrices are the coil signature matrices and the B matrices are the magnetic state signatures matrices. Each row of the matrices is the signature vector of a single coil or magnetic state. To solve these equations for the control current vector I, requires transpose preprocessing in order to produce square and invertible matrices. Thus, multiplying equation (1) by the transpose of $B_H$ yields:

$$B_H^T(H-A_H I_O)=B_H^T B_H M. \quad (3)$$

and multiplying equation (2) by the transpose of $A_K$ yields:

$$A_K^T A_K I+A_K^T B_K M=0 \quad (4)$$

Thus, inverting the square matrix $A_K^T A_K$, $$I=-(A_K^T A_K)^{-1} A_K^T B_K M \quad (5)$$

and from equation (3):

$$I=-(A_K^T A_K)^{-1} A_K^T B_K (B_H^T B_H)^{-1} B_H^T (H-A_H I_O)=GH_{eff} \quad (6)$$

which is the solution for the coil currents for optimum degaussing. Note that control matrix G is predetermined from the signature database: optimum coil currents are determined directly from measured hull signatures and existing coil currents. In Equation (3) the hull signature is converted into the magnetic state vector M which is then converted to appropriate coil currents through the keel coil signature matrix, $A_K$, in Equations (4) and (5). The signature transfer matrix is the function of the B matrices in equation (6).

The coil 14 15, and 16 signature matrices are measured by varying the coil currents, one at a time, and observing the corresponding signature changes at hull sensors 12 and keel sensors 13. Measurement of coil signature data, the A matrix can be done by exciting the coils individually with low amplitude sinusoidal current and observing the signatures per current which result. This eliminates direct current offset, as well as hysteresis, and any errors due to other magnetic instabilities that would arise during direct current measurements.

The magnetic state signature matrices, B, are evaluated in any of three methods:

a. The magnetic state can be modelled in terms of distributed dipoles, prolate spheroids or finite elements. These procedures work well for ship platforms with discrete sources and for underwater platforms at ranges dependent upon the complexity of the model.

b. Excitation of segments of the ship platform using external local "Helmholtz" coils generate local magnetizations from which magnetic states can be synthesized. Onboard degaussing coils can be temporarily flashed, overexcited, to generate "coil perm", but these magnetization distributions may not describe all magnetic states.

c. A third determination of the signature transfer matrix is through normal or simulated ship platform experience, aided by a ranging or a temporary self-ranging capability. Since $B_H$ and $B_K$ are measured simultaneously for each magnetic state, the magnitude and dimension of these virtual states M do not effect the signature transfer matrix, which is invariant with respect to the method of generating the B matrices. Since the bulk of magnetization changes are due to induced or dive perm (in underwater platforms), signature data can be collected for a series of experiences, each being one line of the B matrix. These experiences, if wide enough, form a complete set from which all signatures can be synthesized on the hull and the keel. For objects of cylindrical symmetry and finite length, such as ship platforms, the signatures are measured at discrete points along the keel line near the ship to fully characterize the ship. The spatial frequency of signature data is twice the maximum frequency of information observable, which is characterized by the distance from the measurement point to the keel, or the centerline. At each point, vector field signatures are required to describe the vector magnetic states. Thus, the signature vectors are generalized to 3N dimensional where N is the number of sensor sites.

The number, placement and character of sensors offboard (midrange or keel) are preferably one ship radius apart at one ship diameter below the centerline. Onboard they are equal density. Each sensor is triaxial and aligned precisely to avoid mixing components of the Earth's field. It is preferred that sensors be spaced uniformly along the length of the ship, though such is not necessary. The sensor positions and orientations must be consistent for each data base. Further, for simplicity in data transmission and physical security, sensor placement internal to the hull is preferable. Sensors can be enclosed in magnetic shielding to average out any local spatial noise and filtered to average temporal noise.

The removal of the Earth's magnetic field is accomplished by use of a reference magnetometer displaced from the main body of the ship either on a boom or towed. A gradiometer can also be utilized. The gradiometer must use ample baseline to maximize the difference signal without generating increased noise due to the flexing of the ship or baseline in the Earth's field. The baseline of a local gradiometer is oriented radially, away from the centerline. The precise alignment of all sensors with the reference sensor is crucial in removing the Earth's field.

ADVANTAGES OF THE INVENTION

The system and method of this invention provides an advantage of improved signature reduction for any type of ship platform. It provides data bases of any platform on the magnetic field due to degaussing coil activation and due to various magnetic states at local and midrange sensor sites. The controller then takes local real-time magnetic sensor data, determines the magnetic state and the corresponding degaussing coil current settings and implements them iteratively. The controller is inherently linear yet treats accurately non-linear relationship between magnetic state and magnetoelastic environment. The capability of this invention to remove platform magnetic signature, or any other measurable field, reduces threat to the platform.

Many obvious modifications in the details and arrangement of parts may be made, however, without departing from the true spirit and scope of the invention, as more particularly defined in the appended claims.

What is claimed is:

1. A closed-loop matrix method for controlling magnetic signatures surrounding a three dimensional space at distances away from a centerline of the space exceeding the distances between degaussing coils within the space comprising:

providing a plurality of degaussing coils within the space for degaussing;

providing a plurality of sensors within the space for measuring magnetic state signatures;

measuring simultaneously internal space signatures and signatures external to the space for preparing coil and magnetic state signature matrices;

determining a control matrix, for the coil currents from internal space magnetic signatures; and controlling the coil and magnetic state signature by repeatedly determining the coil currents from internal space signatures using the control matrix for control purposes.

2. A closed-loop matrix method as in claim 1 wherein a plurality of sensors are placed outside the space for initially measuring external magnetic field signatures.

3. A method for minimizing the magnetic field surrounding a three dimensional space comprising the steps of:

determining a plurality of electrical currents according to the relationship $$\vec{I} = -(A_K^T A_K)^{-1} A_K^T B_K (B_H^T B_H)^{-1} B_H^T (H - A_H I_O) = G H_{eff}$$

wherein $A_K$ represents an exterior to the three dimensional space coil signature matrix $B_K$ represents an exterior to said space magnetic state signature matrix $B_H$ represents surface or interior to said space magnetic state signature matrix $A_H$ represents surface or interior to said space coil signature matrix $I_O$ represents the initial coil currents G represents the degaussing coil control matrix $H_{eff}$ is the effective magnetic field H is the set of magnetic fields at the sensor locations within said space, providing a plurality of degaussing coils inside the three dimensional space each coil having one of said plurality of electrical currents flowing in it whereby the magnetic field surrounding the said three dimensional space is minimized.

* * * * *

UNITED STATES PATENT AND TRADEMARK OFFICE

CERTIFICATE OF CORRECTION

PATENT NO. : 5,189,590

DATED : February 23, 1993

INVENTOR(S) : Carl S. Schneider

It is certified that error appears in the above-indentified patent and that said Letters Patent is hereby corrected as shown below:

On the Title page:

"[75] Inventor: Carl S. Schneider, Annapolis, MD." Please add --; Bruce R. Hood, Arnold, Maryland; Douglas G. Everstine, Severna Park, Maryland and Francis E. Baker, Jr., Gambrils, Maryland--

Signed and Sealed this

Twenty-fifth Day of January, 1994

*Attest:*

*Attesting Officer*

BRUCE LEHMAN

*Commissioner of Patents and Trademarks*